US006986839B2

(12) United States Patent
Subramaniyam et al.

(10) Patent No.: US 6,986,839 B2
(45) Date of Patent: Jan. 17, 2006

(54) METHOD FOR PREVENTION OF FOULING IN BASIC SOLUTION BY INHIBITING POLYMERIZATION AND SOLUBILIZING DEPOSITS USING AMINO ACIDS

(75) Inventors: Mahesh Subramaniyam, Thane West (IN); Bankar Prashant, Kalamboli (IN)

(73) Assignee: Dorf Ketal Chemicals (1) PVT Ltd., Mumbai (IN)

( * ) Notice: Subject to any disclaimer, the term of this patent is extended or adjusted under 35 U.S.C. 154(b) by 106 days.

(21) Appl. No.: 10/134,661

(22) Filed: Apr. 29, 2002

(65) Prior Publication Data

US 2003/0205503 A1 Nov. 6, 2003

(51) Int. Cl.
*C10G 9/16* (2006.01)

(52) U.S. Cl. ..... 208/48 AA; 208/48 R; 208/47

(58) Field of Classification Search ..... 208/48 AA, 208/48 R, 47
See application file for complete search history.

(56) References Cited

U.S. PATENT DOCUMENTS

| | | | | |
|---|---|---|---|---|
| 3,364,130 | A | 1/1968 | Barnun et al. | 208/48 |
| 4,010,141 | A | 3/1977 | Onozuka et al. | 260/45.75 |
| 4,443,340 | A | 4/1984 | May et al. | 210/697 |
| 4,673,489 | A | 6/1987 | Roling | 208/289 |
| 4,752,374 | A | 6/1988 | Reid | 208/48 |
| 4,952,301 | A | 8/1990 | Awbrey | 208/48 |
| 5,160,425 | A | 11/1992 | Lewis | 208/95 |
| 5,194,143 | A | 3/1993 | Roling | 208/291 |
| 5,220,104 | A | 6/1993 | McDaniel et al. | 585/953 |
| 5,264,114 | A | 11/1993 | Dunbar | 208/48 |
| 5,288,394 | A | 2/1994 | Lewis et al. | 208/48 |
| 5,527,447 | A | 6/1996 | Roof | 208/48 |
| 5,582,808 | A | 12/1996 | Patek | 423/210 |
| 5,614,080 | A | 3/1997 | Roof | 208/48 |
| 5,700,368 | A | 12/1997 | Roof | 208/48 |
| 5,710,455 | A | 1/1998 | Bhatnagar et al. | 257/472 |
| 5,714,055 | A | 2/1998 | Lewis et al. | 208/48 |
| 5,770,041 | A | 6/1998 | Lewis et al. | 208/48 |
| 5,879,534 | A | 3/1999 | Lewis et al. | 208/48 |
| 6,372,121 | B1 | 4/2002 | McClain et al. | 208/48 AA |

OTHER PUBLICATIONS

PCT International Search Report for International Application No. PCT/IB03/01624 dated Aug. 27, 2003 (4p.).

*Primary Examiner*—Walter D. Griffin
(74) *Attorney, Agent, or Firm*—Conley Rose, P.C.

(57) ABSTRACT

A method for inhibiting and dissolving the deposits formed on caustic or alkaline scrubbers used in scrubbing acidic gases such as carbon dioxide, hydrogen sulfide, which are formed during the pyrolytic cracking of naphtha, ethane, and propane. The cracking operations produce certain oxygenated compounds such as vinyl acetate or acetaldehyde, which undergo polymerization under alkaline condition. The vinyl acetate on hydrolysis releases acetaldehyde under alkaline conditions. Amino acids such as 6 amino caproic acid and lactams such as epsilon caprolactam not only prevent but also dissolve the polymers formed by aldol condensation.

30 Claims, No Drawings

METHOD FOR PREVENTION OF FOULING IN BASIC SOLUTION BY INHIBITING POLYMERIZATION AND SOLUBILIZING DEPOSITS USING AMINO ACIDS

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD OF THE INVENTION

The present invention relates to a method for inhibiting and dissolving polymeric deposits that tend to form in caustic or alkaline scrubbers. More particularly, the present invention relates to the use of certain aliphatic amino acids, sultam acid, or lactams to inhibit deposition and dissolve deposits. Still more particularly this invention relates to method for prevention of fouling in a basic solution that is in contact with a gaseous or liquid hydrocarbon stream that is effluent from a hydrocarbon cracking operation.

BACKGROUND OF THE INVENTION

In pyrolytic cracking operations, feedstocks such as ethane, propane, naphtha, kerosene, gas oil, fuel oil and the like undergo "cracking," i.e. the removal of hydrogen, to form unsaturated hydrocarbons. Pyrolytic cracking also tends to produce oxygenated hydrocarbons, including carbonyl compounds such as acetaldehyde. In a typical operation, the cracked effluent stream is quenched and fractionated and compressed. Acidic contaminants such as hydrogen sulfide, carbon dioxide and mercaptans are typically then removed from the effluent hydrocarbon stream by washing in a caustic scrubber.

The caustic scrubber partially removes the oxygenated hydrocarbons. At the same time, however, the basic conditions in the scrubber tend to cause base-induced condensation reactions of the carbonyl compounds, including in particular aldehydes (e.g., acetaldehyde) and/or ketones, which in turn result in the formation of polymers. The polymers deposit and form on the internal surfaces of the scrubber. As the mass of polymer grows, it leads to fouling and can eventually obstruct the flow of liquids through the system. This is undesirable, as the down-time required to remove the deposited polymer and clean the equipment can be significant.

In the past, polymerization of oxygenated compounds, such as carbonyl-containing organics in basic solutions, has been stopped by adding amine compounds such as hydroxylamine hydrochloride, hydroxylamine sulfate, hydrazine, carbohydrazides and the like. Several patents relate to methods of inhibiting carbonyl fouling. But no patent has been reported regarding the dissolution of the polymers once formed.

U.S. Pat. No. 4,673,489 discloses using hydroxylamine and its salts of hydrochloric acid and sulfuric acid to inhibit polymer formation caused by condensation reactions of aldehydes contained in caustic scrubber units. One disadvantage of the method is that the additive has to be used in almost molar proportion.

U.S. Pat. No. 4,952,301 discloses using ethylenediamines with the molecular formula $N_2(CH_2CH_2NH)_xH$ where x is an integer ranging from 1 to about 10 to inhibit carbonyl based fouling, particularly aldehyde fouling, that often occurs during caustic scrubbing of liquid or gas phase hydrocarbon streams in the base wash unit.

U.S. Pat. No. 5,264,114 also discloses the use of amine compounds to inhibit the deposition of foulants during caustic washing of the hydrocarbon gases contaminated with the carbonyl compounds which comprises of treating the hydrocarbon gases with an aqueous amine solution wherein the aqueous amine solution comprises water and an amine compound having a concentration range of 2 ppm to about 5000 ppm and wherein the amine compound is selected from group of organic compound of the formula $RNH_2$ and $R_2NH$, wherein R is selected from the group of alkyl or aryl groups.

Carbohydrazide has been disclosed in U.S. Pat. No. 5,160,425 as useful for inhibiting polymeric fouling deposits during the caustic scrubbing of pyrolytically-produced hydrocarbons contaminated with oxygen-containing compounds.

U.S. Pat. No. 5,288,394 describes a method of inhibiting formation of polymeric fouling deposits after caustic scrubbing of a hydrocarbon stream contaminated with oxygenated compounds with a basic washing solution having pH more than 7, comprising adding to the hydrocarbon stream a sufficient amount of a compound that inhibits formation and deposition of fouling materials comprising at least one hydrazide compound.

U.S. Pat. No. 5,194,143, granted to Roling describes and claims a method for inhibiting the formation of polymeric based fouling deposits during the basic washings of olefins containing hydrocarbon contaminated with oxygenated compounds comprising adding to the wash about 1 to 10000 parts pre million acetoacetate ester compound having the formula $CH_3COCH_2C_xH_y$ where x is an integer from about 1 to about 8 and y is an integer from about 3 to about 17. U.S. Pat. No. 5,220,104 discloses the use of percarbonate salts for the same purpose.

In U.S. Pat. No. 5,770,041 Lewis et al. describe the use of certain aldehydic compounds without alpha hydrogen atom or non-enolizable aldehydes such as formaldehyde or glyoxal as aldol inhibitors. Relatively large amounts of the inhibitors disclosed in the '041 patent must be used per mole of carbonyl species.

U.S. Pat. No. 5,710,455 discloses the use of certain organic amine inhibitor like sulfanilic acid for inhibiting the aldol condensation but this patent does not disclose the use of said inhibitor for dissolving the polymer once made which is extremely severe fouling conditions.

Finally, amide condensation products of alkylene polyamines with high molecular weight monocarboxylic acids for reducing or preventing the fouling of processing equipment in petroleum or chemical industries are disclosed in U.S. Pat. No. 3,364,130. In the '130 patent, the fouling occurs during heat transfer and is taking place when the system is heated from 200 to 1300° F. The '130 patent does not address fouling that occurs as a result of alkaline conditions. In addition, while the species that cause fouling in '130 is believed to be olefins and dienes; the '130 patent does not address fouling that is derived from carbonyl compounds.

One disadvantage of the prior art systems is that once the acetaldehydes undergo addition reaction to form high molecular weight polymers, the prior art additives are ineffective for removing them. In addition, the prior art additives typically require additive to reactant molar ratios of at least 1:1 for effective performance. The adducts of the high molecular weight polymers with these compounds tend to be insoluble in the basic system. Thus, the prior art additives are ineffective for the purpose of maintaining unobstructed flow through the system.

Another current practice in the industry is to treat the weak caustic with gasoline or another aromatic fraction in order to remove the polymers before sending it to the spent caustic oxidation unit, in order to prevent fouling there. The resulting gasoline-containing streams cause disposal and operational problem, however. Likewise, routing the gasoline-containing stream to other operating units can cause problems due to the presence of the caustic, as it may effect pH, catalyst and the like.

Hence, despite the various advances in the art, it remains desirable to provide an additive that will inhibit polymerization and also dissolve polymers that are already deposited. In addition, the polymeric deposits also cause fouling of downstream units and can pose environment problems of disposal if aromatics are used to remove deposits from the basic wash system. Hence, it is desired to provide a method for preventing fouling that does not create problems in equipment downstream of the scrubber and that does not pose significant environmental problems.

SUMMARY OF THE INVENTION

The present invention overcomes the disadvantages of the prior art and provides a method and composition for both preventing fouling and removing polymeric deposits. In a preferred embodiment, the present invention includes a method for inhibiting oxygenated hydrocarbon fouling that does not interfere with overall plant operations or the operation of individual process units. The present method provides the additional advantage of reducing the concentration of oxygenated hydrocarbons and particularly carbonyl compounds in equipment and in product streams. An alternative embodiment of the present invention includes certain aliphatic amino acids, such as 6 amino caproic acid, sultam acid, and/or lactams such as epsilon caprolactam, which not only prevent but also dissolve the polymer formed by aldol condensation. The preferred compounds can be used alone, or in combination with each other and/or in combination with hydroxyl amine sulfate or sulfanilic acid.

DETAILED DESCRIPTION OF THE PREFERRED EMBODIMENTS

The present invention includes a method of inhibiting and dissolving the polymeric deposits formed in caustic or alkaline scrubbers that are used for scrubbing acidic gases such as carbon dioxide and hydrogen sulfide from the effluent streams formed during the pyrolytic cracking of naphtha, ethane, and propane. The cracking operations also produce oxygenated compounds such as vinyl acetate or acetaldehyde, which undergo polymerization under the alkaline conditions in the scrubber. Upon hydrolysis under alkaline conditions vinyl acetate releases acetaldehyde., hence contributes further to the buildup of polymeric deposits In a preferred embodiment of the present method, certain aliphatic amino acids, including but not limited to 6 amino caproic acid are used to mitigate the effects of polymerization in the system. It has been discovered that aliphatic amino acids, and particularly 6 amino caproic acid, not only prevent but also dissolve the polymers formed by the aldol condensation described above.

In another preferred embodiment of the present method, sultam acid and certain lactams, including but not limited to epsilon caprolactam (molecular weight 113), are used to mitigate the effects of polymerization in the system. It has been discovered that caprolactam not only prevents but also dissolves the polymers formed by the aldol condensation described above.

When amino acids or lactams are used, they react with the low and high molecular weight molecular weight polymer and the reacted adduct is soluble in the caustic solution. Thus, the amino acids both solubilize the polymers formed and prevent precipitation and fouling of the equipment. The present additives have the dual advantage of working as polymerization inhibitor by reacting with acetaldehydes as well as solublizing any existing polymers by reacting with them.

According to a preferred embodiment, 6 amino hexanoic acid or any suitable aliphatic acid or its isomers or any such derivatives having an amino and/or carboxyl and sulfonic acid as described in the structures, when used in accordance with the present invention, will resolve fouling problem associated with acetaldehyde/ketones in alkaline wash towers in petrochemical plants.

Amino acids that are particularly suited for use in the accordance with the present invention include but are not limited to: 6 amino acid such as the amino hexanoic acid made from epsilon caprolactum, glycine, or taurine, or any compound having one of the structures shown below. Also suitable are the derivatives, isomers, and inorganic or organic salts of these compounds. Also suitable are amino acid derived from $(HOOZ)_w$-PH—$(CH_2)_xNH_2$, where x is an integer from 1 to 6, Z is C or S , w is an integer from 1 to 4, and PH is a phenyl ring, and amino acids derived from $((HOOZ)\text{-}(CH_2)_x)_w$PH—$(CH_2)_yNH_2$, where x and y are any integer, Z is C or S, w is an integer from 1 to 4, and PH is phenyl ring.

1) $NH_2—(CH_2)_n—COOH$, n = 1 to 10

2) $CH_3—(CH_2)_n—COOH$, n = 1 to 10 ($NH_2$)

3)

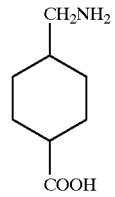

4)

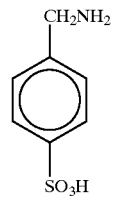

5)

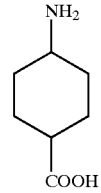

-continued

6)

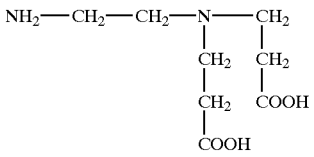

It has been discovered that the compounds described in the preceding paragraph are effective polymerization inhibitors for aldol condensation reactions, as well as solubilizing any polymer that may already have been formed by that mechanism. For purposes of this invention, an acetaldehyde polymer may be defined as having 2 or more repeating units of acetaldehyde.

In accordance with the invention, the amino acid may be added to the alkaline scrubber in an amount representing a molar ratio of carbonyl to amine from about 1:0.01 to about 1:25 mole. Preferably the amino acid is added to the alkaline scrubber in amount representing a molar ratio of carbonyl to amine from about 1:0.05 to 1:0.0.5. In an alternative embodiment of the invention, a lactam may be added to the alkaline scrubber in an amount representing a molar ratio of carbonyl to lactam from about 1:0.01 to about 1:25 mole. The lactam is preferably added to the alkaline scrubber in amount representing a molar ratio of carbonyl to lactam from about 1:0.5 to 1:0.25.

Further in accordance with the invention, the amino acid in its salt form or in pure amino acid form can be added either as neat product or as an aqueous solution containing 0.05 to greater than 60 weight percent of the amino acid, with 18 wt. % preferred. Similarly, the lactam can be added either as neat product or as an aqueous solution containing 0.05 to greater than 60 weight percent of the amino acid, with 18–38 wt % being preferred.

The preferred amount of additive ranges from 0.5 to 1,000,000 parts of inhibitor per one million part of the aqueous scrubbing medium used in the caustic wash system. In field conditions, treatments of 25 to 200 ppm have been successfully used.

The following Examples are merely illustrative of some embodiments of the present invention and the manner in which it is can be performed and are not intended to limit the scope of the claimed invention in any way:

EXAMPLE 1

20 ml 10–11% strength caustic solution is placed in a 50 ml stoppered conical flask and to it is added 1 ml of vinyl acetate. The mixture is shaken thoroughly. The vinyl acetate hydrolyses to acetaldehyde and undergoes polymerization rapidly to form a deep yellow turbid solution. Polymerization may be enhanced by heating. After 10 minutes of polymerization under basic conditions 1.0 g amino caproic acid is added and the mixture is held at 55° C. for 2 hours. At the end of 2 hours the solution is a clear, transparent wine-red liquid, thus a method is described which can then be used for further prevention of fouling in basic solution.

EXAMPLE 2

20 ml. 10–11% strength caustic solution is placed in a stoppered 50 ml conical flask and to it is added 1 ml of vinyl acetate. The mixture is shaken thoroughly. The vinyl acetate hydrolyses to acetaldehyde and undergoes polymerization rapidly to form a deep yellow turbid solution. Polymerization is further carried out at 55° C. for 2 hours. After 2 hours of polymerization under basic conditions, a dark red gummy polymer was found floating on the top and the bottom caustic layer was a hazy yellow solution. To this were added 2.8 g of amino caproic acid and the mixture was kept at 55° C. After 24 hours the solution was a transparent wine red liquid, indicating that the polymer that had been present was dissolved. The resulting clear solution is useful for further prevention of fouling in basic solution.

EXAMPLE 3

A clean four-necked round bottom flask equipped with a thermometer, stirrer and condenser is charged with caprolactum (18 g, 0.1593 mole), sodium hydroxide (7 g, 0.175 g) and 75.0 g water. The mixture is well agitated and heated to 105° C. to 120° C. for a period of six hours. Small samples are periodically withdrawn and checked for conversion using HPLC. The conversion of epsilon caprolactum to six amino hexanoic acid is greater than 75%.

EXAMPLE 4

A clean four-necked round bottom flask equipped with a thermometer, stirrer and condenser is charged with caprolactum (36 g, 0.3186 mole), 3 g of 36% hydrochloric acid in 61g water. The mixture is agitated well and heated to 105° C. to 110° C. for six hours. A small sample is withdrawn and checked for conversion using HPLC. The conversion of epsilon caprolactum to six amino hexanoic acid is greater than 75%.

EXAMPLE 5

20 ml of 10% NaOH solution is added to a 50 ml stoppered conical flask. To this inhibitor solution or in solid form is added followed by addition of 1 ml vinyl acetate. Each mixture is shaken well and kept in an oven at 55° C. for 2 hrs. One control sample is prepared, in which all components except the inhibitor are added. After two hours the contents of the flasks are visually checked for clarity or any deposits. In few cases UV at 800 nm is recorded for comparison.

EXAMPLE 6

20 ml of 10% NaOH solution is pipetted into a 50 ml stoppered conical flask. To this is added 1 ml of vinyl acetate solution. The mixture is shaken well and kept in oven for 15 minutes. During this period, the vinyl acetate is hydrolyzed and polymerizes to form insoluble products. After 15 minutes the desired amount of inhibitor is added. One control sample is prepared without inhibitor. The flask is shaken well and kept in an oven for 2 hours. After 2 hours the flask is checked visually for clarity and any deposits. In some cases UV transmittance is measured for comparison. The results are shown in Table 2.

EXAMPLE 7

The procedure of Example 6 was used, except that the polymerization time was increased to 1 hr.

The present invention can be also be used as a blend with hydroxyl amine sulfate and sulfanilic acid without the loss of activity for both inhibition and dissolution of polymers, as described below in Example 8 and shown below in Table 4.

EXAMPLE 8

20 ml of 10% NaOH solution are added to a 50 ml stoppered conical flask. To this is added the desired inhibitor in solution or in solid form, followed by the addition of 1 ml vinyl acetate. The mixture is shaken well and kept in an oven for 2 hrs at 55° C. One blank is prepared wherein all reagents except the inhibitor are added. At the end of two hours, the contents of the flask are visually checked for clarity or any deposits. In few cases UV transmittance at 800 nm is measured for comparison. The results are shown in Table 4 below.

EXAMPLE 9

A plant was having severe fouling in the benzene stripper. The unit fouled within 24 hrs after the introduction of live steam in the column. The unit was being treated by conventional red oil inhibiting compound described in the prior art. A compound in accordance with the present invention was injected at low dosage in the benzene stripper and the unit ran for more than 25 days without any signs of fouling even after injection of live steam in the column. This illustrates the effectiveness of the present compounds in running difficult to treat units. Thus a method is described which shows the superiority of solubilizing over prior art inhibition and dispersing techniques.

EXAMPLE 10

A clean four necked round bottom flask equipped with a thermometer, stirrer and condenser is charged with caprolactum (36 g, 0.3185 mole), sodium hydroxide (14.4 g, 0.36 g) and 49.60 g water. The mixture is well agitated and heated to 105° C. to 120° C. for a period of six hours. Small samples are periodically withdrawn and checked for conversion using HPLC. The conversion of epsilon caprolactum to six amino hexanoic acid is greater than 75%.

EXAMPLE 11

20 ml of 10% NaOH solution is added to a 50 ml stoppered conical flask. To this caprolactum (mw 113, m.p 70–72° C.) is added followed by addition of 1 ml vinyl acetate. Each mixture is shaken well and kept in an oven at 55° C. for 24 hrs. One control sample is prepared, in which all components except the inhibitor are added. After two hours the contents of the flasks are visually checked for clarity or any deposits. In few cases UV at 800 nm is recorded for comparison.

Various results are shown in Tables 1–5.

TABLE 1

| Sample No. | Inhibitor | Amount | Observation after 2 hrs | % Transmittance after 2 hrs |
|---|---|---|---|---|
| 1 (ctrl) | — | NIL | Dark red opaque liquid | 0.5% |
| 2 | Example 3 | 0.5 ml | Dark reddish brown solution | 8.5% |
| 3 | Example 3 | 0.75 ml | Dark clear red solution | 80.0% |
| 4 | Example 3 | 1 ml | Dark clear red solution | 85% |
| 5 | Sulfanilic acid | 0.25 g | Brownish hazy solution | 0.3% |
| 6 | Sulfanilic acid | 0.5 g | Reddish brown slightly hazy solution | 78.1% |
| 7 | Sulfanilic acid | 1.0 g | Reddish clear solution | 88% |

TABLE 1-continued

| Sample No. | Inhibitor | Amount | Observation after 2 hrs | % Transmittance after 2 hrs |
|---|---|---|---|---|
| 8 | Taurine | 0.363 g | Reddish brown liquid with particles | 13.3% |
| 9 | Taurine | 0.8 g | Brown clear liquid | 93.8% |
| 10 | Glycine | 0.218 g | Reddish brown hazy liquid | 12.5% |
| 11 | Glycine | 0.432 g | Reddish brown clear liquid | 95% |
| 12 | Glycine | 0.872 g | Reddish brown clear liquid | 96% |
| 13 | Beta alanine | 0.258 g | Reddish brown hazy liquid with particles | 7.6% |
| 14 | Beta alanine | 0.517 g | Dark red clear liquid | 80.4% |
| 15 | Example 4 | 0.5 ml | Reddish brown liquid | 80% |
| 16 | Example 4 | 1.0 ml | Dark red clear solution | 82% |
| 17 | 18% Hydroxyl amine sulfate solution in water | 1.0 ml | Reddish brown hazy liquid | 2.1% |
| 18 | 18% Hydroxyl amine sulfate solution in water | 3.0 ml | Yellow hazy liquid | 4.7% |
| 19 | 18% Hydroxyl amine sulfate solution in water | 4.0 ml | Yellow clear liquid | 90% |
| 20 | Example 10 | 0.25 ml | Clear red liquid | 78% |
| 21 | Example 10 | 0.5 ml | Clear red liquid | 85% |

TABLE 2

| Sample No. | Compound | Amount | Observation after 2 hrs | % Transmittance after 2 hrs |
|---|---|---|---|---|
| 1 (ctrl) | — | NIL | Dark red opaque liquid | 0.5% |
| 2 | Example 3 | 1 ml | Dark red clear solution | 80.5% |
| 3 | Example 3 | 2 ml | Dark clear red solution | 83.0% |
| 4 | Sulfanilic acid | 1.0 g | Brownish hazy solution with particles | 0.5% |
| 5 | Sulfanilic acid | 4.0 g | Reddish brown hazy solution with particles | 0.5% |
| 6 | Sulfanilic acid | 6.0 g | Brown hazy solution with particles | 0.5% |
| 7 | Taurine | 1.5 g | Reddish brown hazy liquid with particles | 6.6% |
| 8 | Taurine | 2.91 g | Reddish Brown hazy liquid with particles | 8.9% |
| 9 | Glycine | 0.872 g | Reddish brown hazy liquid | 6.6% |
| 10 | Glycine | 2.618 g | Reddish brown hazy liquid | 8.9% |
| 11 | Beta alanine | 0.517 g | Reddish brown hazy liquid with particles | 5.7% |
| 12 | Beta alanine | 1.034 g | Reddish brown hazy liquid with particles | 26.3% |
| 13 | Beta alanine | 2.32 g | Reddish clear with slight haze. | 63.2% |
| 14 | Example 4 | 1.0 ml | Dark Red clear liquid | 80% |
| 15 | Example 4 | 2.0 ml | Dark red clear solution | 80% |
| 16 | 18% Hydroxyl amine sulfate solution in water | 1.0 ml | Reddish brown hazy liquid | 26.3% |
| 17 | 18% Hydroxyl amine sulfate solution in water | 4.0 ml | Yellow hazy liquid with settling at the bottom | 40.1% |
| 18 | Example 10 | 0.5 ml | Clear red liquid | 81% |
| 19 | Example 10 | 1.0 ml | Clear red liquid | 82% |

TABLE 3

| Sample No. | Compound | Amount | Mole ratio | Observation after 24 hrs | % Transmittance after 24 hrs |
|---|---|---|---|---|---|
| 1 | — | Nil | Nil | Completely hazy brown liquid | 0.5 |
| 2 | Amino caproic acid | 1.4196 g | 1: 1 mole | Reddish brown clear liquid | 80.1 |
| 3 | Amino caproic acid | 0.709 g | 1: 0.5 mole | Reddish brown clear liquid | 78.7 |
| 4 | Amino caproic acid | 0.3549 g | 1: 0.25 mole | Reddish brown clear liquid with slight particles | 55.2 |
| 5 | Sulfanilic acid | 4.0 g | 1: 2 mole | Brown hazy with particles | 0.8% |
| 6 | Sulfanilic acid | 2.0 g | 1: 1 mole | Hazy brown liquid with particles | 0.4% |
| 7 | Example 10 | 3.4 ml** (3.94 g) | appl: 1 mole* | Dark reddish liquid | 82% |
| 8 | Example 10 | 1.7 ml (1.969 g) | Appl: 0.5 mole* | Dark reddish clear solution | 78.7% |
| 9 | Example 10 | 0.85 ml (0.985 g) | appl: 0.25 mole* | Dark reddish clear solution | 45.3% |

*approximately
**specific gravity of example is 1.1592

TABLE 4

| Sample No. | Product | Quantity | Observation after 2 hrs | Percent transmittance after 2 hrs |
|---|---|---|---|---|
| 1 | Example 4 + hydroxylamine sulfate solution 36% l | 2 ml + 2 ml | Clear red solution | 82% |
| 2 | Example 3 + sulfanilic acid | 2 ml + 2 gms | Clear red solution | 80% |
| 3 | Example 3 + caprolactam | 2 ml + 0.5 gms | Clear red solution | 82% |
| 4 | Caprolactam + sulfanilic acid | 1 gms + 2 gms | Clear red solution | 80% |
| 5 | Caprolactam + hydroxyl amine sulfate | 1 gm + 2 gms | Clear red solution | 81% |

TABLE 5

| Example No. | Grams of caprolactum | Ratio of moles of Vinyl Acetate to caprolactum | Observation after 24 hrs | UV Transmittance after 24 hrs |
|---|---|---|---|---|
| 1 | 0.6122 | 1:0.5 | Clear dark reddish brown liquid | 71.5% |
| 2 | 0.3061 | 1:0.25 | Dark reddish brown hazy liquid | 0.8% |
| 3 | 1.224 | 1:1 | Dark reddish clear liquid | 76.4% |
| 2 | 2.449 | 1:2 | Dark reddish clear liquid | 73% |

EXAMPLE 12

20 ml of 10% NaOH solution is pipetted into a 50 ml stoppered conical flask. To this is added 1 ml of vinyl acetate solution. The mixture is shaken well and kept in oven for 15 minutes at 50–55° C. During this period, the vinyl acetate is hydrolyzed and polymerizes to form insoluble products. After 15 minutes a desired amount of epsilon caprolactum (mw 113 m.p 70–72° C.) inhibitor is added. One control sample is prepared without inhibitor. The flask is shaken well and kept in an oven for 24 hours. After 24 hours the flask is checked visually for clarity and any deposits. In some cases UV transmittance is measured for comparison. The results are shown in Table 6.

TABLE 6

| Example No. | Grams of caprolactum | Ratio of moles of Vinyl Acetate to caprolactum | Observation after 24 hrs | UV Transmittance after 24 hrs |
|---|---|---|---|---|
| 1 | 0.6122 | 1:0.5 | Dark reddish brown liquid with slight particles | 64.4% |
| 2 | 1.224 | 1:1 | Dark reddish clear liquid | 76% |
| 3 | 2.449 | 1:2 | Dark reddish clear liquid | 81% |
| 4 | Beta alanine 2.32 gm | 1:2.4 | Brown liquid with settling in the bottom | 12.7% |

EXAMPLE 13

20 ml of 10% NaOH solution is pipetted into a 50 ml stoppered conical flask. To this is added 1 ml of vinyl acetate solution. The mixture is shaken well and kept in oven for 30 minutes at 50–55° C. During this period, the vinyl acetate is hydrolyzed and polymerizes to form insoluble products. After 30 minutes the desired amount of epsilon caprolactum (mw 113 m.p 70–72° C.) inhibitor is added. One control sample is prepared without inhibitor. The flask is shaken well and kept in an oven for 24 hours. After 24 hours the flask is checked visually for clarity and any deposits. In some cases UV transmittance is measured for comparison. The results are shown in Table7.

TABLE 7

| Example No. | Grams of caprolactum | Ratio of moles of Vinyl Acetate to caprolactum | Observation after 24 hrs | UV Transmittance after 24 hrs |
|---|---|---|---|---|
| 1 | 1.224 | 1:1 | Dark reddish clear liquid | 78% |
| 2 | 2.449 | 1:2 | Dark reddish clear liquid | 81% |

EXAMPLE 14

20 ml of 10% NaOH solution is pipetted into a 50 ml stoppered conical flask. To this is added 1 ml of vinyl acetate solution. The mixture is shaken well and kept in oven for 1 hrs minutes at 50–55° C. During this period, the vinyl acetate is hydrolyzed and polymerizes to form insoluble products. After 1 hrs minutes the desired amount of epsilon caprolactum (mw 113 m.p 70–72° C.) inhibitor is added. One control sample is prepared without inhibitor. The flask is shaken well and kept in an oven for 24 hours. After 24 hours the flask is checked visually for clarity and any deposits. In some cases UV transmittance is measured for comparison. The results are shown in Table 8

TABLE 8

| Example No. | Grams of caprolactum | Ratio of moles of Vinyl Acetate to caprolactum | Observation after 24 hrs | UV Transmittance after 24 hrs |
|---|---|---|---|---|
| 1 | 1.224 | 1:1 | Dark reddish clear liquid | 50% |
| 2 | 2.449 | 1:2 | Dark reddish clear liquid | 75% |
| 3 | Beta alanine 2.32 gm | 1:2.4 | Brown liquid with settling in the bottom | 3.0% |

The basic wash systems in which the present treatments are useful for inhibiting fouling include amine acid gas scrubber and caustic wash systems. While the present invention has been described herein in terms of preferred embodiments, one of ordinary skill in the art will recognize that modifications to the embodiments can be made without departing from the scope of the claimed invention.

What is claimed is:

1. A method for inhibiting and dissolving polymeric deposits on the internal surfaces of a caustic wash system, said deposits resulting from polymerization as a result of aldol condensation of at least one component of a feed stream, comprising adding to the feed stream an additive effective to inhibit polymerization and dissolve said deposits, wherein said additive is selected from the group consisting of 6 amino hexanoic acid, taurine, $NH_2(CH_2)_xYO_z$ OH, where x is an integer from 1 to 12, Y can be S or C, and z=1 to 2, isomers, salts, and combinations thereof, and beta alanine and salts thereof.

2. The method of claim 1 wherein said polymeric deposits are derived from carbonyl compounds.

3. The method of claim 1 wherein said additive is 6 amino hexanoic acid made from alkaline hydrolysis of epsilon caprolactum using an agent selected from the group consisting of potassium hydroxide, sodium hydroxide, lithium hydroxide, calcium hydroxide, magnesium hydroxide, organic or inorganic bases capable of reacting with epsilon caprolactum such that an amino and an carboxyl group are created, and combinations thereof.

4. The method of claim 1 wherein the pH of the caustic wash system is greater than 7.

5. The method of claim 1 wherein the caustic wash system comprises a caustic scrubber.

6. The method of claim 1 wherein the caustic wash system comprises an amine scrubber.

7. The method of claim 1 wherein the additive has more than one carboxyl or sulfoxyl group.

8. A method for inhibiting and dissolving polymeric deposits on the internal surfaces of a caustic wash system, said deposits resulting from polymerization as a result of aldol condensation of at least one component of a feed stream, comprising adding to the feed stream an additive effective to inhibit polymerization and dissolve said deposits, wherein said additive comprises amino hexanoic acid derived from epsilon caprolactam.

9. A method for inhibiting and dissolving polymeric deposits on the internal surfaces of a caustic wash system, said deposits resulting from polymerization as a result of aldol condensation of at least one component of a feed stream, comprising adding to the feed stream an additive effective to inhibit polymerization and dissolve said deposits, wherein said additive is an acid salt of 6 ammo hexanoic acid with an acid selected from the group consisting of hydrochloric acid, sulfuric acid, perchloric acid and organic acids.

10. The method of claim 9 wherein said organic acid is any suitable organic acid capable of hydrolyzing epsilon caprolactam.

11. The method of claim 9 wherein said organic acid is any suitable organic acid capable of forming a salt with said 6 amino hexanoic acid.

12. A method for inhibiting and dissolving polymeric deposits on the internal surfaces of a caustic wash system, said deposits resulting from polymerization as a result of aldol condensation of at least one component of a feed stream, comprising adding to the feed stream an additive effective to inhibit polymerization and dissolve said deposits, wherein the additive is selected from the group consisting of 6 amino hexanoic acid and sodium salts of amino hexanoic acid and wherein the component in the feed stream is a carbonyl compound and the molar ratio of carbonyl compound to amino hexanoic acid is between 1:10 and 1:0.01.

13. A method for inhibiting and dissolving polymeric deposits on the internal surfaces of a caustic wash system, said deposits resulting from polymerization as a result of aldol condensation of at least one component of a feed stream, comprising adding to the feed stream an additive effective to inhibit polymerization and dissolve said deposits, wherein said additive is a derivative of $(HOOZ)_w$—PH—$(CH_2)_xNH_2$, where x is an integer from 1 to 6, Z is C or S , w is an integer from 1 to 4, and PH is a phenyl ring.

14. A method for inhibiting and dissolving polymeric deposits on the internal surfaces of a caustic wash system, said deposits resulting from polymerization as a result of aldol condensation of at least one component of a feed stream, comprising adding to the feed stream an additive effective to inhibit polymerization and dissolve said deposits, wherein said additive is a derivative of $((HOOZ)(CH_2)_x)_wPH—(CH_2)_yNH_2$, where x and y are any integer, Z is C or S, w is an integer from 1 to 4, and PH is a phenyl ring.

15. A method for inhibiting and dissolving polymeric deposits on the internal surfaces of a caustic wash system, including deposits that are existent or are formed as a result of aldol condensation, said deposits resulting from polymerization of at least one component of a feed stream, comprising adding to the feed stream an additive comprising an amount of a lactam, sultam, or isomers thereof effective to inhibit polymerization and dissolve said deposits.

16. The method of claim 15 wherein the lactam comprises epsilon caprolactam or isomers or substituted derivatives thereof.

17. The method of claim 15 wherein the polymeric deposits are derived from carbonyl compounds.

18. The method of claim 15 wherein the pH of the caustic wash system is greater than 7.

19. The method of claim 15 wherein the caustic wash system comprises a caustic scrubber.

20. The method of claim 15 wherein the caustic wash system comprises an amine scrubber.

21. The method of claim 15 wherein the sultam is capable of being hydrolysed with an acid or a base.

22. The method of claim 15 wherein the lactam is epsilon caprolactam and the component in the feed stream is a carbonyl compound and the molar ratio of said carbonyl compound to said lactam or said sultam is between 1:10 and 1:0.01.

23. The method according to claim 1 or 15, further comprising dissolving the polymer formed in the caustic wash system and units downstream therefrom.

24. The method according to claim 23, wherein the downstream units include a gas or naptha cracking plant.

25. The method of claim 1 or 15 wherein the additive is used as blend or individually.

26. The method of claim 1 or 15 wherein the additive is in solid or in liquid state.

27. The method of claim 1 or 15 wherein the additive is added without any preference to sequence of addition.

28. The method of claim 1 or 15, further comprising blending with the additive a second polymerization inhibitor or solvent.

29. The method of claim 1 wherein said component in said feed stream comprises a carbonyl compound and the molar ratio of said carbonyl compounds to said additive is between 1:10 and 1:0.01.

30. The method of claim 15 wherein said component in said feed stream comprises a carbonyl compound and the molar ratio of said carbonyl compounds to said lactam or said sultam or to said isomers thereof is between 1:10 and 1:0.01.

* * * * *